US009890738B2

(12) United States Patent
Pöschl et al.

(10) Patent No.: US 9,890,738 B2
(45) Date of Patent: Feb. 13, 2018

(54) CYLINDER HEAD FOR AN INTERNAL COMBUSTION ENGINE

(71) Applicant: AVL LIST GMBH, Graz (AT)

(72) Inventors: Robert Pöschl, Judendorf-Strassengel (AT); Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 185 days.

(21) Appl. No.: 14/889,651

(22) PCT Filed: May 7, 2014

(86) PCT No.: PCT/EP2014/059282
§ 371 (c)(1),
(2) Date: Nov. 6, 2015

(87) PCT Pub. No.: WO2014/180873
PCT Pub. Date: Nov. 13, 2014

(65) Prior Publication Data

US 2016/0108850 A1 Apr. 21, 2016

(30) Foreign Application Priority Data

May 8, 2013 (AT) ..... A 50314/2013

(51) Int. Cl.

| | |
|---|---|
| ***F02F 1/40*** | (2006.01) |
| ***F02F 1/36*** | (2006.01) |
| ***F01P 3/14*** | (2006.01) |
| ***F01L 3/22*** | (2006.01) |

(52) U.S. Cl.
CPC *F02F 1/36* (2013.01); *F01L 3/22* (2013.01); *F01P 3/14* (2013.01); *F02F 1/40* (2013.01); *F01L 2810/01* (2013.01)

(58) Field of Classification Search
CPC ..... F02F 1/36; F02F 1/40; F01L 3/22; F01P 3/14
See application file for complete search history.

(56) References Cited

U.S. PATENT DOCUMENTS 4,593,655 A * 6/1986 Mezger ..... F02F 1/40 123/188.9

FOREIGN PATENT DOCUMENTS

| | | |
|---|---|---|
| CH | 272380 | 3/1951 |
| GB | 668962 | 3/1952 |
| GB | 2101212 | 1/1983 |
| GB | 2101212 A * | 1/1983 |
| JP | 5715918 | 6/1980 |
| JP | 5935623 | 3/1984 |

(Continued)

*Primary Examiner* — Kevin A Lathers
(74) *Attorney, Agent, or Firm* — Dykema Gossett PLLC

(57) ABSTRACT

The invention relates to a cylinder head (1) for an internal combustion engine having at least one cylinder, having at least one valve seat ring (3) for a lifting valve, wherein the valve seat ring (3) is surrounded by an annular cooling duct (4) for a coolant that is at least partly molded into the cylinder head (1), wherein the cooling duct (4) at least partly surrounds the valve seat ring and extends between an inlet (5, 15, 25) and at least one outlet (6). In order to reduce the valve wear, provision is made for a plurality of inlets (5, 15, 25) to open into the cooling duct (4), wherein the inlets (5, 15, 25) are preferably arranged asymmetrically in relation to a meridian plane (δ) of the valve seat ring (3) through the outlet (6).

13 Claims, 4 Drawing Sheets

(56) References Cited

FOREIGN PATENT DOCUMENTS

| | | |
|---|---|---|
| JP | 59107009 | 7/1984 |
| WO | 2008059108 | 5/2008 |
| WO | 2010145940 | 12/2010 |

* cited by examiner

CYLINDER HEAD FOR AN INTERNAL COMBUSTION ENGINE

BACKGROUND OF THE INVENTION

Field of the Invention

The invention relates to a cylinder head for an internal combustion engine, comprising at least one cylinder, at least one valve seat ring for a lifting valve, wherein the valve seat ring is surrounded by an annular cooling duct for a coolant that is at least partly moulded into the cylinder head, wherein the cooling duct at least partly surrounds the valve seat ring and extends between an inlet and at least one outlet.

The Prior Art

A valve seat ring for a reciprocating internal combustion engine arranged in a cylinder head is known from WO 08/059108 A, wherein a circumferential cooling duct is arranged in the valve seat ring, which cooling duct extends between an inlet and an outlet for a coolant.

Current high-performance internal combustion engines comprise regions that are highly thermally stressed in the area of the exhaust valve bridges between the exhaust valve seats. These regions are at risk especially concerning thermal deformation and thus increased wear and tear to the valves.

The publications GB 2 101 212 A, JP 959107009 U and JP 55935623 U show valve seat rings for lifting valves of internal combustion engines with one respective cooling duct, into which several inlets enter and from which at least one outlet branches off. The inlets are respectively symmetrically arranged in relation to a meridian plane of the valve seat rings through the outlet.

WO 2010/145 940 A1 describes a cylinder head for an internal combustion engine with annular cooling channels around exhaust valve seat rings, wherein inlets and outlets of the annular cooling ducts are arranged diametrically opposite with respect to the axis of the valve seat rings. Similar cooling channels around the valve seat rings are known from DE 34 12 052 A1. These symmetrical cooling measures are inadequate however for avoiding thermal deformation of the exhaust valve bridges in the high-performance engines.

CH 272 380 B and GB 668 962 A respectively describe a valve device of an internal combustion engine with an inserted valve seat ring for a poppet valve, wherein the valve seat ring is surrounded by a circumferential cooling duct which extends between an inlet and an outlet. A separating region for the coolant is formed between the inlet and the outlet, which separating region prevents a short-circuit flow between the inlet and the outlet. A similar cooling duct is also disclosed in JP 57-015918 U1. Although this cooling ring arrangement allows asymmetrical cooling of the valve seat rings, the dissipation of heat is insufficient due to the low flow quantities. It is also disadvantageous that the separating region between the inlet and the outlet forms a non-cooled thermal bridge, and local overheating and thermal tensions can thus occur, especially when the separating region is positioned close to the thermally highly loaded web between the two exhaust valves.

It is the object of the invention to avoid these disadvantages and to reduce wear and tear of the valves.

SUMMARY OF THE INVENTION

This is achieved in accordance with the invention in such a way that several inlets open into the cooling duct, wherein the inlets are preferably arranged asymmetrically in relation to a meridian plane of the valve seat ring through the outlet.

A meridian plane of the valve seat ring is understood in this case to be a plane through a point of the curved surface of the valve seat ring which contains its centre of curvature. The meridian plane is thus formed by a radial line and the ring axis of the valve seat ring.

It is provided in a preferred embodiment of the invention that at least one inlet opens obliquely or tangentially into the cooling duct, so that the following applies: $0 \leq \beta < 90°$, wherein the angle $\beta$ is formed between a central line of an inlet duct leading to said inlet and a tangent on the cooling duct in the region of said inlet, wherein the angle $\beta < 80°$, preferably $<75°$, in preferably at least one inlet. As a result, an asymmetric flow can be initiated in the cooling duct, through which thermally highly loaded regions can be cooled in a purposeful manner.

A distinct asymmetric flow can be achieved when at least one inlet opens tangentially into the cooling duct, so that the angle $\beta = 90°$.

It can alternatively or additionally be provided that at least one inlet opens obliquely into the cooling duct, so that the following applies to the angle $\beta$: $0 < \beta < 90°$.

An improvement in the cooling can be achieved when at least one further inlet opens radially into the cooling duct, so that the angle $\beta = 90°$.

As a result, a distinctly asymmetrically pronounced coolant flow can be achieved in the cooling duct. Especially effective heat dissipation has been achieved by an arrangement in which the central line of the inlet duct of the oblique inlet is arranged tangentially on a circle of curvature of an indentation of a preferably radial inlet.

The outlet can be arranged diametrically opposite the (preferably radial) inlet in relation to the valve seat ring centre, wherein preferably the central lines of the inlet and the outlet can be arranged in a meridian plane of the valve seat ring.

It is especially advantageous for heat dissipation from thermally highly loaded regions if a preferably radial inlet can be arranged diametrically opposite the outlet with respect to the centre of the valve seat ring, and wherein the cooling duct can comprise at least one further inlet which is preferably arranged on a first side of a meridian plane of the valve seat ring through the outlet, with said first side facing an exhaust valve bridge. The further inlet can be formed as a tangential inlet which opens tangentially into the cooling duct, or as an oblique inlet which opens obliquely into the cooling duct. An especially preferred embodiment of the invention provides a radial inlet, an oblique inlet and a tangential inlet, wherein the radial inlet can be arranged diametrically opposite the outlet and the two further inlets (the oblique inlet and the tangential inlet) can be arranged on one side of a meridian plane of the valve seat ring through the outlet, especially on the side facing the exhaust valve bridge. This produces good heat dissipation from the region of the exhaust valve bridge. It is especially advantageous if at least two inlet ducts are arranged in such a way that their central lines extending through the respective inlets intersect in a point on a meridian plane of the valve seat ring or in a point in the region of a cooling jacket of a component, especially preferably an injection device, opening centrally into a combustion chamber. As a result of this arrangement, asymmetric cooling with optimal heat dissipation from the exhaust valve bridge can be achieved in a purposeful manner.

It can further be provided within the scope of the invention that the cooling duct, as seen in a sectional view normally to the axis of the valve seat ring, comprises an indentation that is preferably substantially sickle-shaped in the region of at least one inlet and/or the outlet.

Pressure losses occur in known arrangements with an annular cooling duct in the region of the inlet and outlets, which has a negative effect on the cooling and leads to increase valve wear. Flow losses by eddy formation and throttling effects are prevented by the substantially sickle-shaped indentations in the region of the inlet and/or outlet. The throughput of coolant can thus be increased and heat dissipation improved.

Simple production is achieved if the indentation substantially has the shape of a circular segment at least in part and can preferably be produced by a turning tool such as a milling cutter.

Purposeful heat dissipation from thermally highly loaded regions such as the exhaust valve bridge can occur when the indentation is arranged asymmetrically with respect to a meridian plane extending through the centre of the inlet or outlet. The eccentric arrangement of the indentation with respect to the centre of the inlet or outlet leads to an asymmetric allocation of the flow losses and thus the flow quantities of the coolant in both branches of the annular cooling duct, so that the heat dissipation from both branches of the cooling duct is different.

The radius r of the indentation can be between 0.2 times and 0.8 times the outer radius R of the cooling duct, preferably between 0.4 times and 0.6 times the outer radius R of the cooling duct. This leads to an advantageous cross-sectional shape of the flow for the lowest possible flow losses and good cooling effect.

Each inlet is in flow-connection with a respective cast or drilled inlet duct, and the outlet with a cast or drilled outlet duct of the cylinder head.

It is provided in an especially advantageous embodiment of the invention that the cooling duct of the valve seat ring is separated from the cooling system of the remaining cylinder head. This allows using other pressures or cooling media for cooling the valve seat ring than for cooling the cylinder head for example. In particular, the inlet and the outlet can be connected to the lubricating oil system of the internal combustion engine.

BRIEF DESCRIPTION OF THE DRAWINGS

The invention will be explained in greater detail by reference to the drawings, wherein.

DETAILED DESCRIPTION OF THE DEPICTED EMBODIMENTS

Figure 1:
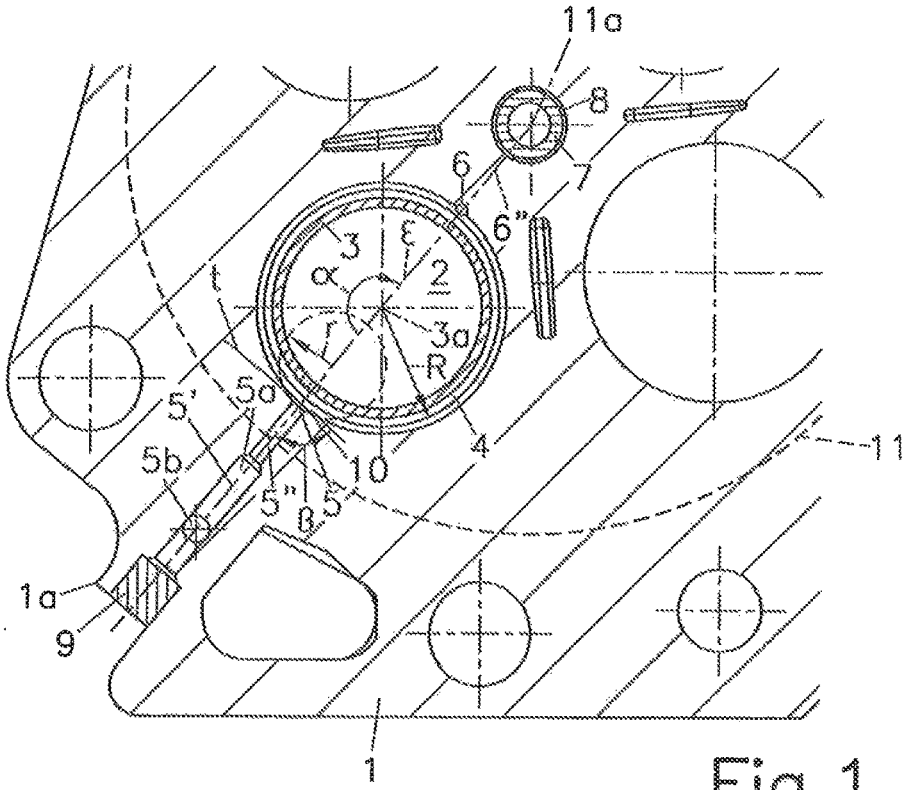
FIG. 1 shows a cylinder head in accordance with the invention in a first embodiment in a sectional view along the line I-I in FIG. 3.

Functionally identical parts are provided with the same reference numerals in the embodiments.

The drawings show a cylinder head 1 for at least one cylinder 11 of an internal combustion engine, comprising at least one exhaust valve 2 which is formed by a lifting valve (not shown in greater detail) and of which only the exhaust valve opening is shown, wherein one valve seat ring 3 is arranged in (e.g., pressed into) the cylinder head 1 at least for each exhaust valve 2. The axis of the valve seat ring 3 is designated with reference numeral 3*a*. The valve seat ring 3, which is pressed or glued into the cylinder head 1, is surrounded by an annular cooling duct 4 for a coolant, which is formed in (e.g., milled into) the cylinder head 1 and which extends between at least one inlet 5 and one outlet 6 over an angular range a of at least 180° around the valve seat ring 3. In the embodiments, the cooling duct 4 is formed circumferentially around the valve seat ring 3. An interrupted configuration can also be considered. The inlet 5 is in connection with an inlet duct 5*a*, and the outlet 6 with an outlet duct 6*a*, wherein the inlet duct 5*a* and the outlet duct 6*a* can be formed by boreholes. The inlet duct 5*a* originates from a lateral surface 1*a* of the cylinder head 1 and is directed radially to the cylinder centre 11*a*. In the region of the cylinder centre 11*a*, a component 7 (e.g., a spark plug or an injection device), which opens centrally into the combustion chamber 14 of the cylinder 11, is arranged in the region of the cylinder centre 11*a*, wherein the component 7 is surrounded at least partly by a cooling chamber 8. The outlet duct 6*a* enters into the cooling chamber 8.

FIG. 1 shows a first embodiment of a cylinder head 1, wherein the cooling duct 4 comprises a substantially sickle-shaped indentation 10 in the orifice region of the inlet duct 5*a* into the cooling duct 4, i.e., in the region of the inlet 5. The indentation 10 can substantially have the shape of a circular segment and can be produced by a cutting turning tool such as a milling cutter for example, Non-cutting production can also be considered, e.g., by an electric discharge machining method. The radius r of the indentation is advantageously selected from the range $0.2 \cdot R \leq r \leq 0.8 \cdot R$, wherein preferably the radius r of the indentation 10 lies between preferably $0.4 \cdot R$ and $0.6 \cdot R$. As a result of an indentation 10 formed in this manner, flow losses in the region of the inlet 5 can be reduced substantially. A similar indentation can also be provided in an analogous manner in the region of the outlet 6 (not shown in greater detail). In FIG. 1, the indentation 10 is symmetrically arranged in relation to a plane E extending through the central line 5'.

Figure 2:
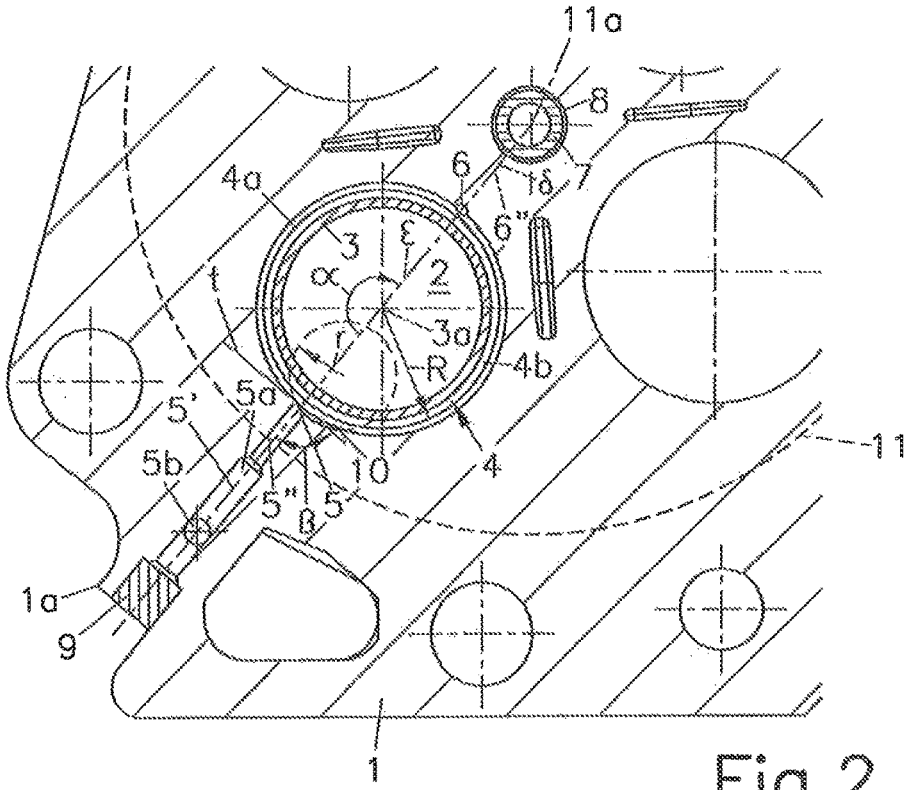
FIG. 2 shows a cylinder head in accordance with the invention in a second embodiment in a sectional view analogously to FIG. 1.
Figure 3:
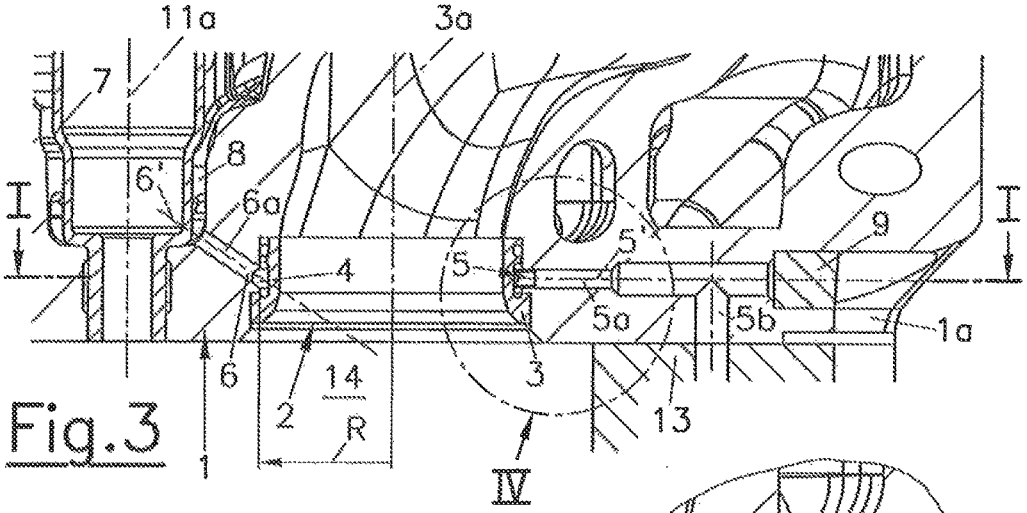
FIG. 3 shows the cylinder head in a sectional view along the line III-III in FIG. 1.
Figure 4:
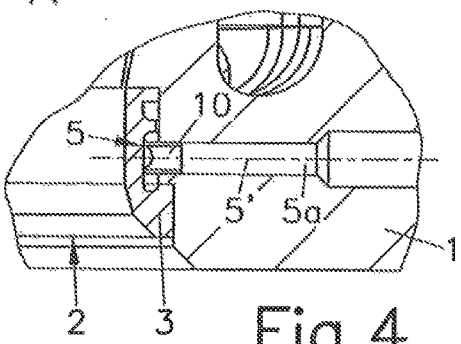
FIG. 4 shows the detail IV of FIG. 3.

FIG. 2 shows a second embodiment which differs from FIG. 1 in such a way that the indentation 10 is arranged asymmetrically in relation to a meridian plane $\epsilon$ extending through the centre 5" of the inlet 5 and/or a meridian plane $\delta$ of the valve seat ring 3 extending through the outlet 6. The flow losses during the incoming flow of the coolant into the cooling duct 4 are reduced on the one hand and an asymmetric division of quantities of the coolant is produced on the other hand into the two annular sections 4*a*, 4*b* of the cooling duct 4. Higher heat dissipation can thus be achieved on one side of the meridian plane $\epsilon$ and $\delta$ than on the other side. In particular, the heat dissipation is increased on the side of the meridian plane $\epsilon$, $\delta$ in which the major part of the sickle-shaped indentation 10 is arranged. FIG. 3 and FIG. 4 show the arrangement in a sectional view in the meridian plane ϵ, δ, wherein the inlet 5 is shown in detail in FIG. 4.

Figure 5:
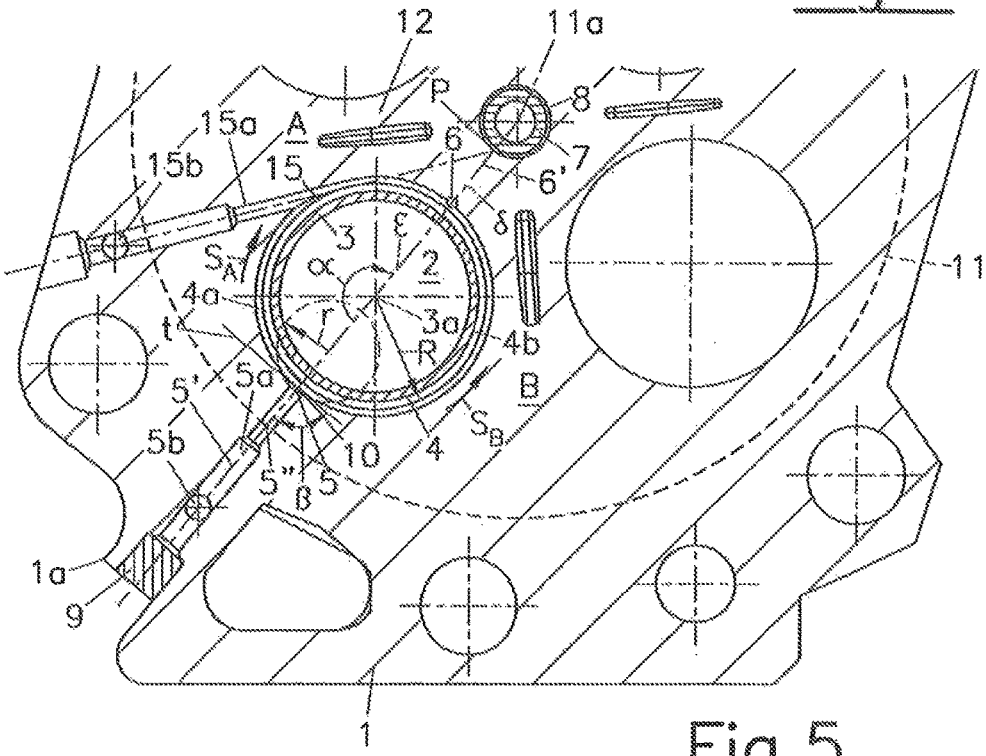
FIG. 5 shows a cylinder head in accordance with the invention in a third embodiment in a sectional view analogously to FIG. 1.

FIG. 5 shows the cylinder head 1 in a third embodiment, wherein a tangential inlet 15 with a tangential inlet duct 15*a* is provided in addition to a radial inlet 5 having a radial inlet duct 5*a*. The tangential inlet duct 15*a* opens tangentially into the annular cooling duct 4. This leads to a pronounced highly asymmetrical coolant flow in the cooling duct 4, wherein a higher quantity of coolant flows according to the arrows $S_A$, $S_B$ through the section 4*a* of the cooling duct 4 facing the exhaust valve bridge 12 than through the other section 4*b* that faces away, so that the cylinder head 1 is cooled more strongly on the side A of the Meridian plane ϵ and δ of the valve seat ring 3 than on the side B.

Figure 6:
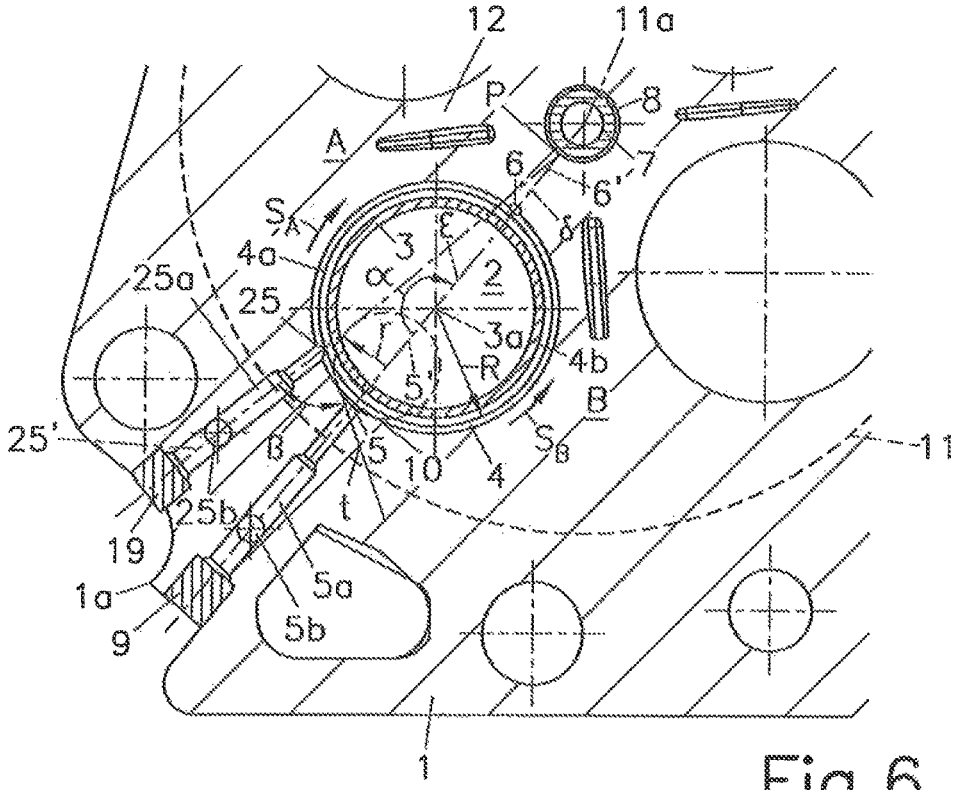
FIG. 6 shows a cylinder head in accordance with the invention in a fourth embodiment in a sectional view analogously to FIG. 1.

FIG. 6 shows a fourth embodiment of the cylinder head 1, wherein similar to FIG. 5 a further inlet 25 with a further inlet duct 25*a* is provided in addition to the radial inlet 5. The further (oblique) inlet duct 25*a* opens on a side A of the plane ϵ and δ under an acute angle β into the annular cooling duct 4, wherein the angle β is formed between a tangent t on the annular cooling duct 4 in the region of the further (oblique) inlet 25 and the central line 25' of the second inlet duct 25. The angle β is selected between 0° and 90°. In the embodiment, the central line 25' of the oblique inlet duct 25*a* is arranged tangentially to a circle of curvature k with the radius of curvature r of an indentation 10 of the first inlet 5. This leads to a pronounced asymmetrical cooling flow according to the arrows $S_A$, $S_B$ in the cooling duct 4, wherein a higher quantity of coolant flows through the section 4*a* of the cooling duct 4 facing the exhaust valve bridge 12 than through the other section 4*b* that faces away. The cylinder head 1 is also cooled more strongly here on the side A of the plane ϵ and δ than on the side B.

Figure 7:
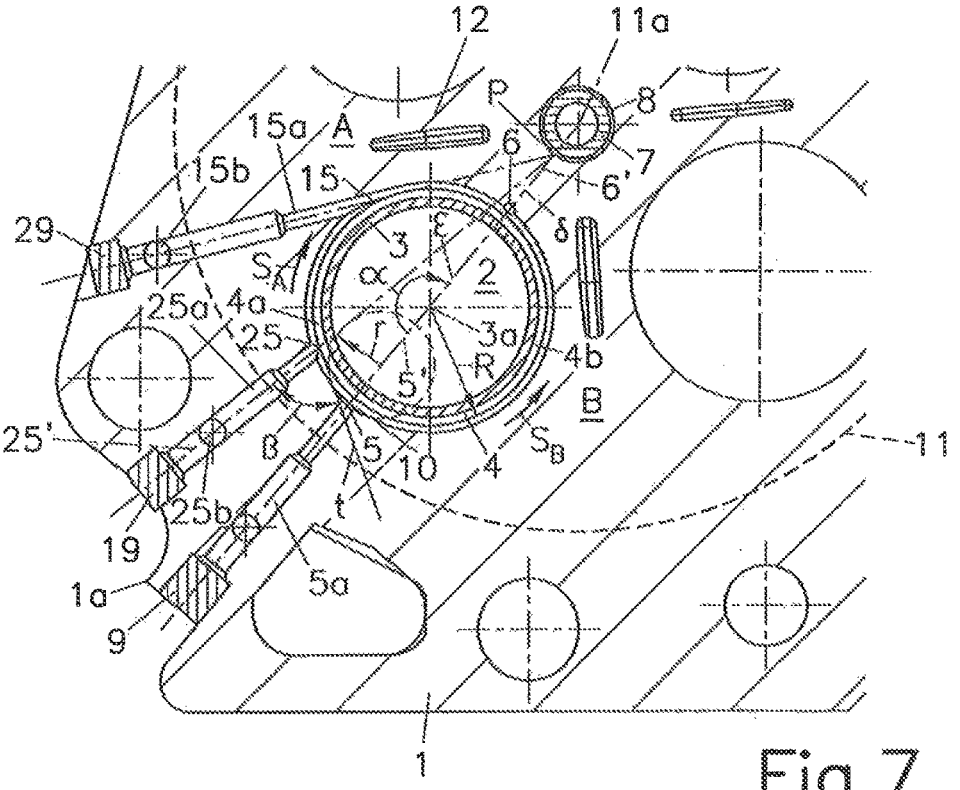
FIG. 7 shows a cylinder head in accordance with the invention in a fifth embodiment in a sectional view analogously to FIG. 1.

FIG. 7 shows a fifth embodiment of the cylinder head 1 with a combination of the measures shown in FIG. 5 and FIG. 6. In addition to the radial inlet 5, two further inlets (i.e. a tangential inlet 15 and an oblique inlet 25) are provided, wherein the one tangential inlet 15 comprises a tangential inlet duct 15*a* which opens tangentially into the cooling duct 4 and the oblique inlet 25 comprises an oblique inlet duct 25*a* which enters at an acute angle into the cooling duct 4. The oblique cooling duct 25*a* enters into the annular cooling duct 4 on a side A of the plane ϵ and δ under an acute angle β, wherein the angle β is formed between a tangent t on the annular cooling duct 4 in the region of the oblique inlet 25 and the central line 25' of the oblique inlet duct 25. The angle β is selected between 0° and 90°. Both second inlet ducts 15*a*, 25*a* open into the annular cooling duct 4 on a side A of the plane ϵ and δ, which faces the exhaust valve bridge 12. This leads to an especially strongly pronounced asymmetrical coolant flow according to the arrows $S_A$, $S_B$ in the cooling duct 4, wherein a substantially higher quantity of coolant flows through the section 4*a* of the cooling duct 4 facing the exhaust valve bridge 12 than through the other section 4*b* that faces away. The cylinder head 1 is thus cooled to a substantially higher extent on the side A of the plane ϵ than on the side B.

As is shown in FIG. 5, FIG. 6 and FIG. 7, the inlet ducts 5, 15, 25 can be formed in such a way that their central lines 5', 15', 25' extending through the respective inlets 5, 15, 25 intersect in a point P on a meridian plane δ of the valve seat ring 3 through the outlet 6. The point P is advantageously located in the region of the cooling jacket 8 of the component 7 opening centrally into the combustion chamber 14. This allows simple production in combination with simultaneously highly effective heat dissipation from the region of the exhaust valve bridge 12.

Boreholes for the first and second inlet ducts 5*a*, 15*a*, 25*a* are subsequently sealed in the region of the side surface is of the cylinder head 1 by plugs 9, 19, 29.

The embodiments are shown by way of example with one single outlet 6 each. It is understood that configurations with several outlets lie within the scope of the invention.

Figure 8:
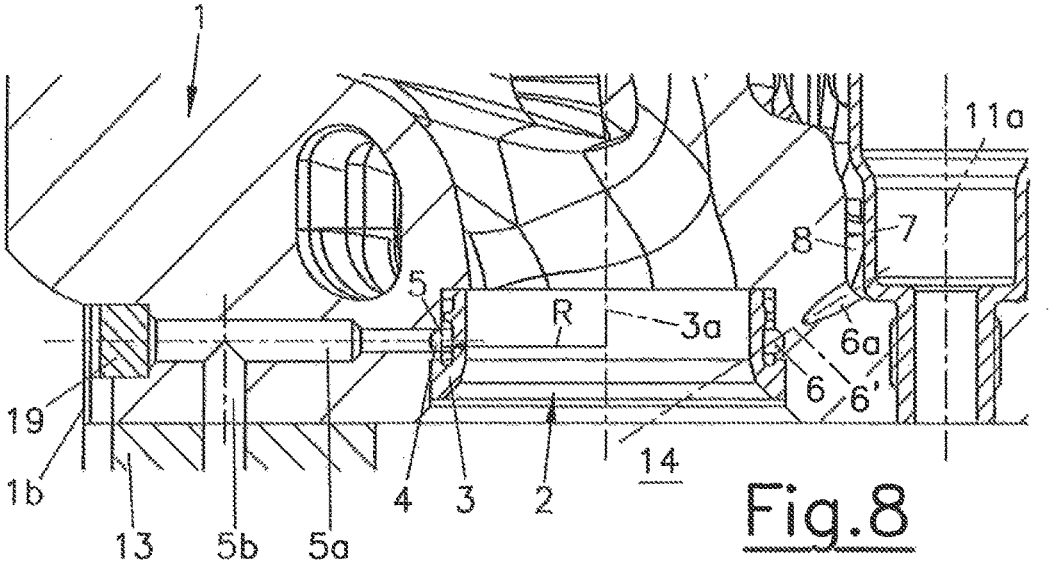
FIG. 8 shows the cylinder head in a sectional view along the line VIII-VIII in FIG. 7.

The inlet ducts 5*a*, 15*a*, 25*a* of the inlets 5, 15, 25 can be connected to a pressure source in the cylinder block 13 (indicated in FIG. 3 and FIG. 8), which is flanged onto the cylinder head 1, via vertical boreholes 5*b*, 15*b*, 25*b*, so that the coolant flow occurs from the inlets 5, 15, 25 to the outlets 6. The outlet duct 6*a* of the outlet 6 can be flow-connected via the cooling jacket 8 of the central component 7 to the cooling jacket 8 of the cylinder head 1. Alternatively thereto, embodiments with reversed coolant flow from the outlets 6 to the inlets 5, 15, 25 can be considered, in which therefore the outlets 6 are connected to a pressure source and the inlets 5, 15, 25 are connected to a pressure sink. The scope of protection of the present application covers all possible directions of coolant flow.

Variants can also be considered within the scope of the present application in which the coolant circuit for the coolant ducts 4 are formed for cooling the valve seat rings 3 separate from the cooling circuit of the cylinder head 1. As a result, various cooling media such as cooling water on the one hand and lubricating oil on the other hand can thus be used for cooling the cylinder head 1 and for cooling the valve seat rings 3.

The invention claimed is:

1. A cylinder head for an internal combustion engine, comprising a cylinder, a valve seat ring for a lifting valve, an annular cooling duct for a coolant at least partly moulded into the cylinder head and at least partly surrounding the valve seat ring, the cooling duct including a plurality of inlets and one outlet, wherein the inlets are arranged asymmetrically in relation to a meridian plane of the valve seat ring which extends through the outlet, wherein a first inlet of said plurality of inlets opens obliquely into the cooling duct, so that an angle β between a central line of a first inlet duct extending to the first inlet and a tangent of the cooling duct in a region of the first inlet is greater than 0° and less than 90°, and a second inlet opens radially into the cooling duct, so that a central line of a second inlet duct extending to said second inlet extends at a 90° angle to a tangent of the cooling duct in a region of said second inlet.

2. The cylinder head according to claim 1, wherein the angle β is <80°.

3. The cylinder head according to claim 2, wherein the angle β is <75°.

4. The cylinder head according to claim 1, wherein one of said plurality of inlets is arranged diametrically opposite the outlet with respect to an axis of the valve seat ring.

5. The cylinder head according to claim 4, wherein the second inlet duct is arranged diametrically opposite the outlet with respect to an axis of the valve seat ring.

6. The cylinder head according to claim 1, wherein one of said plurality of inlets is arranged on a first side of a meridian plane of the valve seat ring through the outlet, said first side facing an exhaust valve bridge.

7. The cylinder head according to claim 1, wherein the cooling duct, when seen in a sectional view normally to the axis of the valve seat ring, comprises at least one substantially sickle-shaped indentation in the region of at least one inlet and/or the outlet.

8. A cylinder head according to claim 7, wherein the indentation substantially has the shape of a circular segment at least in part, and can be produced by a turning tool.

9. The cylinder head according to claim 7, wherein the indentation is arranged asymmetrically with respect to a meridian plane extending through the centre of the first inlet or the outlet.

10. The cylinder head according to claim 7, wherein the following applies to the radius r of the indentation with respect to the radius R of the cooling duct: $0.2 \cdot R \leq r \leq 0.8 \cdot R$.

11. The cylinder head according to claim 7, wherein the central line of the inlet duct of an inlet opening obliquely into the cooling duct is arranged tangentially on a circle of curvature of an indentation of a further inlet which opens radially into the cooling duct.

12. The cylinder head according to claim 1, wherein at least two of said plurality of inlet ducts are arranged in such a way that their central lines extending through the respective inlets intersect in a point on a meridian plane of the valve seat ring through the outlet, and/or in a point in the region of a cooling jacket of a component which opens centrally into the combustion chamber.

13. The cylinder head according to claim 1, wherein the cooling duct of the valve seat ring is separated from a cooling system of the cylinder head.

* * * * *